United States Patent [19]

Chu

[11] Patent Number: 4,845,471

[45] Date of Patent: Jul. 4, 1989

[54] DOOR LOCK

[76] Inventor: Kans C. Chu, No. 250, Yuan Shan Rd., Chung Ho, Taipei Hsien, Taiwan

[21] Appl. No.: 99,527

[22] Filed: Sep. 22, 1987

[51] Int. Cl.[4] ..... E05B 45/06; G08B 13/08; H01H 27/06

[52] U.S. Cl. ..... 340/542; 70/432; 200/61.64; 200/61.67; 340/547

[58] Field of Search ..... 340/542, 545, 547, 521, 340/522; 200/61.64, 61.67, 61.68; 70/DIG. 49, 432, 439, 440

[56] References Cited

U.S. PATENT DOCUMENTS 3,810,145 5/1974 Gusaras ..... 200/61.67 X
3,833,899 9/1974 Blosse ..... 200/61.68 X
4,241,337 12/1980 Prada ..... 340/547
4,565,994 1/1986 Mochida et al. ..... 340/542

*Primary Examiner*—Donnie L. Crosland
*Assistant Examiner*—Thomas J. Mullen, Jr.
*Attorney, Agent, or Firm*—Browdy and Neimark

[57] ABSTRACT

A door lock including a housing, a bolt assembly, a lock mechanism engaged with the bolt assembly and capable of being operated to move the bolt assembly from a locked to an unlocked position, and vice versa. The door lock includes a first switch secured to the housing and in the moving path of the bolt assembly, and adapted to couple with an alarm apparatus, for turning on the alarm apparatus when the bolt assembly is moved to the locked position, and for turning off the alarm apparatus when the bolt assembly is moved to the unlocked position.

19 Claims, 8 Drawing Sheets

DOOR LOCK

BACKGROUND OF THE INVENTION

1. Field of the Invention

The present invention relates to a door lock, and more particularly to a door lock which can control an alarm apparatus to generate an alarm signal when a burglar pries open or damages the door lock.

2. The Prior Art

The commercially-available alarm system is generally turned on/off by a key switch. In some cases, the key switch is installed inside the house. When the occupier wants to leave the house, all the doors, except the front door, and windows must first be closed, and then the key switch be operated to turn on the alarm system. Within a time-delay period of, for example, 30 seconds after the system is turned on, the front door must be closed. In this circumstance, the user always feels a psychological pressure because of the limited time delay. Sometimes, after the alarm system is turned on, the user discovers that something has been forgotten in the house. He has to turn off the alarm system first, and then re-enter the house, or the alarm system will generate an undesired signal. In some cases, the key switch is installed on the outside wall beside the front door. Although this can prevent the above-described disadvantage, it still has several drawbacks. For example, the key switch is fairly easy to pick and destroy in order to shut off the alarm system, and thus cannot offer reasonable security. In both cases, the installation of the key switch is inconvenient, and will damage the wall decoration of the house. In addition, the user has to carry an additional key for the key switch.

Furthermore, the connecting wires of the alarm system are sometimes cut off by the skilled burglar to shut off the alarm system. In addition, since the alarm system is very expensive, it is not widely used.

At present, several door locks which cannot be picked by skeleton keys or other picklocks are commercially available. However, the burglars are still able easily to damage door locks in several ways to open doors. Therefore, such door locks also cannot offer reasonable security.

SUMMARY OF THE INVENTION

Therefore, the primary object of the present invention is to provide a door lock which can turn on an alarm apparatus simultaneously with the locking operation of the door, and turn off the alarm apparatus simultaneously with the unlocking operation of the door.

Another object of the present invention is to provide a door lock which will activate the alarm apparatus to generate an alarm signal when the door lock is pried open or damaged, or when the connecting wire from the door lock to the alarm system is cut off by the burglar.

Yet another object of the present invention is to provide a door lock which is provided with an alarm device therein, to generate directly an alarm signal to frighten burglars and to attract the attention of the neighbors and the person in the house when the door lock is pried open or damaged.

Yet another object of the present invention is to provide a door lock with an inner-installed alarm device which is much cheaper than an alarm system, and can be more widely used.

According to the present invention, a door lock for locking a door within a door frame, comprises a housing, a bolt assembly, a lock mechanism engaged with the bolt assembly and capable of being operated by a user with a key, to move the bolt assembly from a locked to an unlocked position, and vice versa. The door lock is characterized by first means, secured to the housing and in the moving path of the bolt assembly, and adapted to couple with an alarm apparatus, which is turned on and off by the first means when the bolt assembly is moved into the locked and unlocked position, respectively.

Another aspect of the present invention is that it includes an alarm activating means, secured to the housing and coupled with the alarm apparatus, for activating the alarm apparatus to generate an alarm signal when the alarm apparatus is turned on, and the door lock damaged by the burglar wishing to gain entry.

BRIEF DESCRIPTION OF THE DRAWINGS

The present invention can be more fully understood by reference to the following detailed description and accompanying drawings, which form an integral part of this application.

DETAILED DESCRIPTION OF THE PREFERRED EMBODIMENTS

Figure 1:
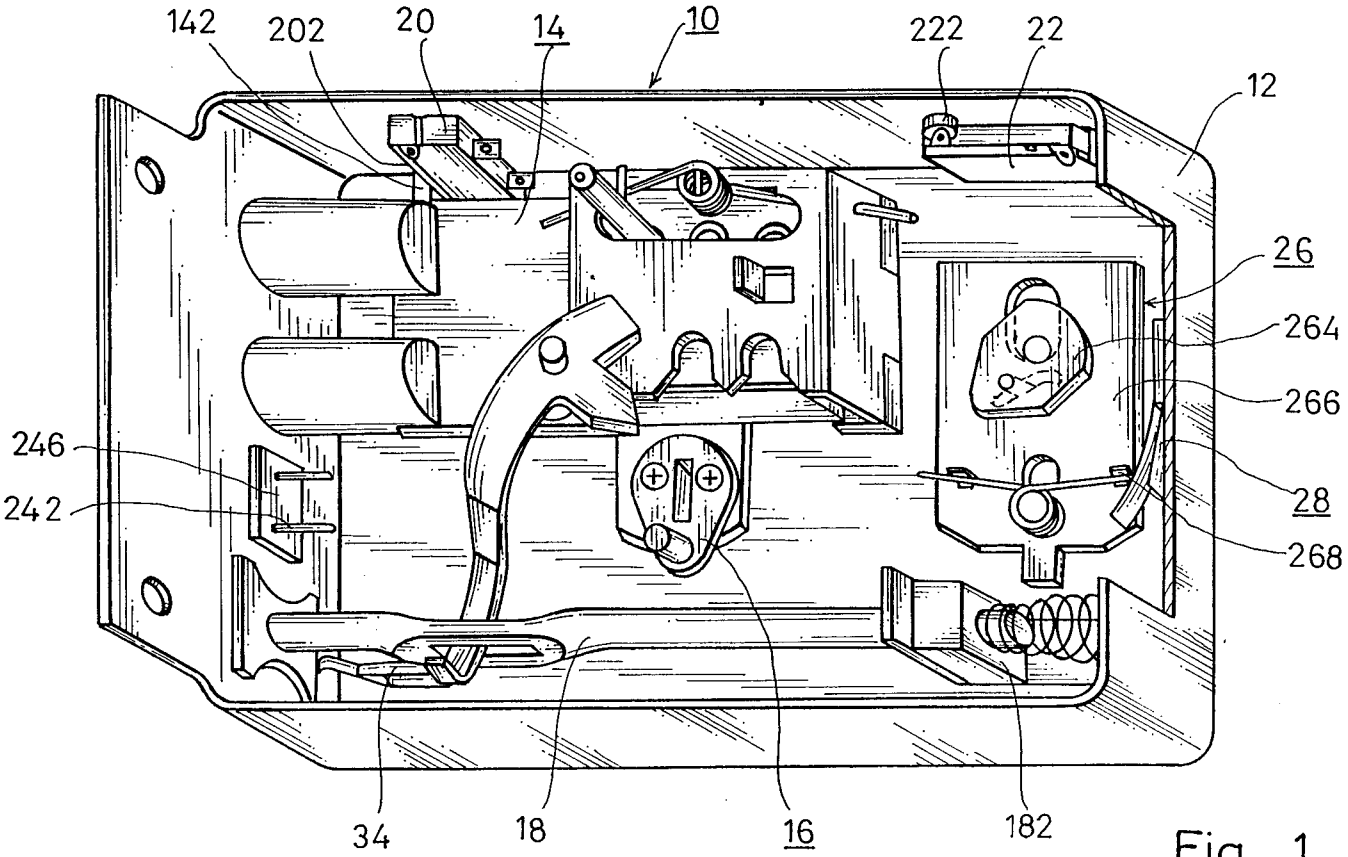
FIG. 1 is an enlarged perspective view of a door lock according to the first preferred embodiment of the present invention, viewed from its back with parts moved and parts broken away to show its inner structure.

Referring now to the drawings, it should be noted that a like component is designated by a like reference number. In FIG. 1, there is illustrated a perspective view of a door lock 10 for an alarm apparatus according to the first preferred embodiment of the present invention, viewed from its back with a back plate 126 (FIG. 3) moved away to show its inner structure. In this embodiment, the main parts of the lock 10 is a conventional triple-step door lock which cannot be picked by skeleton keys or other picklocks. The lock 10 includes a housing 12, a dead bolt assembly 14, a lock mechanism 16, engagable with the dead bolt assembly 14, and a spring-loaded latch bolt 18. One must utilize a correct key to operate the lock mechanism 16 to move the dead bolt assembly 14 in a two-step movement between the locked and unlocked positions, and to move the latch bolt 18 in a one-step movement. Therefore, the door lock 10 can be operated to lock or unlock the door. Since the structure and operation of such a door lock is well known, further detailed description is deemed unnecessary.

The door lock 10 of the present invention further includes a first switch 20 and a second switch 22, both secured to the housing 12. The first and second switch 20 and 22 are preferably micro-switches having operating fingers (202, 222). The first switch 20 can be arranged at any proper place on the moving path of the dead bolt assembly 14. The dead bolt assembly 14 includes a bar 142 to depress the operating finger 202 of the first switch 20 so as to switch off/on the first switch 20 when the dead bolt assembly 14 is moved to the unlocked or right-most position, as shown in FIG. 1. When the dead bolt assembly 14 is moved to the locked or left-most position, the bar 142 will release the operating finger 202 to switch on/off the first switch 20. The second switch 22 can be so arranged at any proper place on the housing 12 that its operating finger 222 projects out of the housing 12 and confronts the door. Therefore, when the door lock 10 is properly fitted onto the door, the operating finger 222 will be depressed to switch on/off the second switch 22. When the door lock 10 is separated by a small distance from the door, the operating finger 222 will spring back to its extended position to switch off/on the second switch 22.

Figure 2:
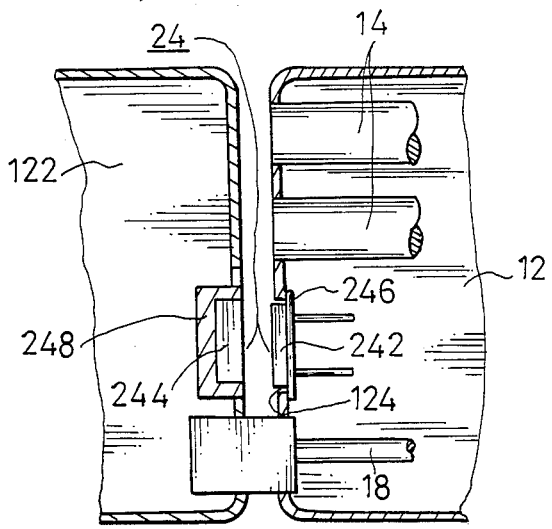
FIG. 2 is a fragmentary cross-sectional view of the door lock of FIG. 1, showing a third switch.

The door lock 10 preferably includes a third switch 24 composed of a magnet-controlled switch 242 and a magnet 244, as best shown in FIG. 2. The magnet-controlled switch 242 is fixed onto the housing 12 through an insulation plate 246, and slightly projects out of the housing 12 through an opening 124 provided in the housing 12. The magnet 244 is secured by a bracket 248 to the door frame, or a bolt holding cover 122 of the door lock 10 mounted on the door frame and confronts the magnet-controlled switch 242. When the door is closed, the magnet 244 is close to the magnet-controlled switch 242, and thus can switch on/off the magnet-controlled switch 242. When the door is opened, the magnet 244 is moved away from the magnet-controlled switch 242, and thus the magnet-controlled switch 242 will return to its original off/on state. To assure that the switch 242 is properly operational, the magnet 244 may be adjustably secured to the bolt holding cover 122 for adjusting the distance to the switch 242, to accommodate various gaps of different widths between the door and door frame.

It should be noted that the first to third switches 20, 22 and 24 can be properly selected, according to the kind of the alarm apparatus with which the door lock 10 is incorporated, to appear at the desired switching states under certain conditions. This can be easily achieved by those who are skilled in the art.

Figure 11:
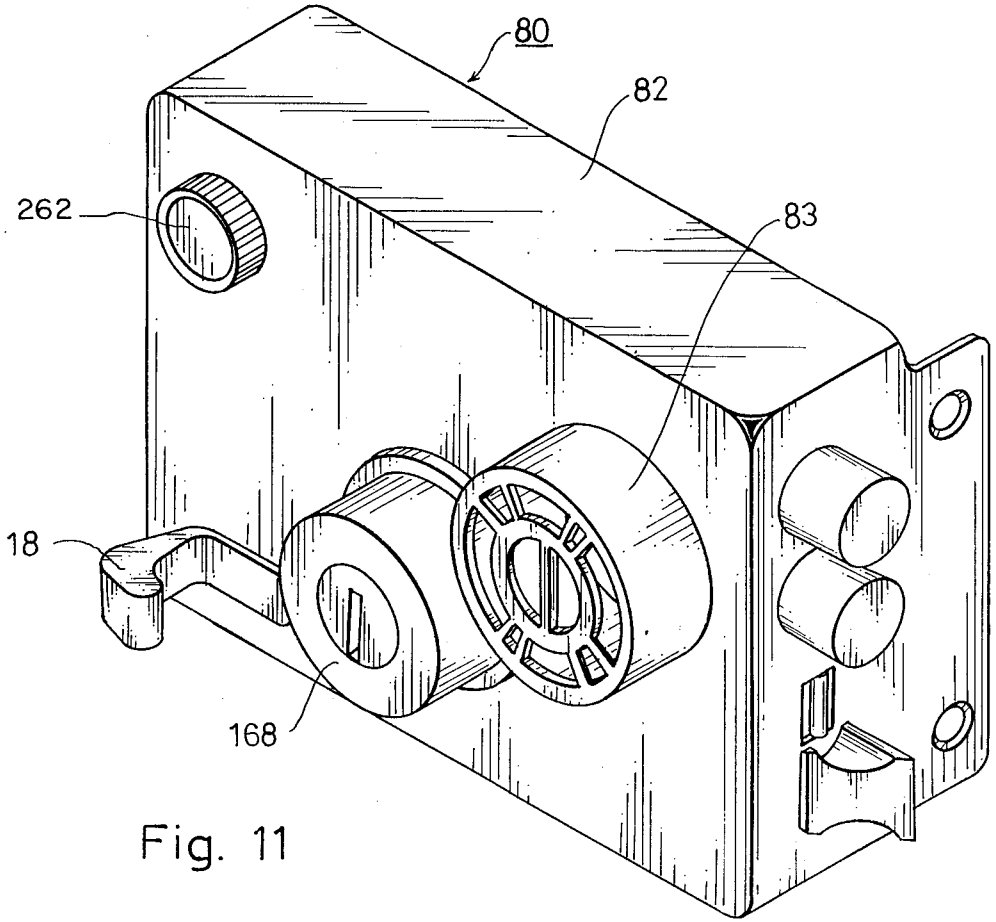
FIG. 11 is an enlarged perspective view of the door lock of FIG. 10, but viewed from the front.

Referring to FIGS. 1 and 11, the door lock includes a latch bolt retaining mechanism 26 provided on the housing 12, and a fourth switch 28 preferably secured to the housing 12 and in the moving path of the latch bolt retaining mechanism 26. The mechanism 26 includes a knob 262 (FIG. 11), an operating plate 264 fixed to the knob 262, and a spring-loaded retaining plate 266. When the knob 262 is turned clockwise (FIG. 11), the operating plate 264 will be rotated to urge the retaining plate 266 downwards. As a result, the lower-most part of the retaining plate 266 will abut against the rear portion 182 of the latch bolt 18 and thus, the latch bolt 18 is retained and cannot be retracted. If the knob 262 is then turned in the opposite direction, the retaining plate 266 will release the latch bolt 18. Since this mechanism is already in existence, further detailed description is deemed unnecessary. The fourth switch 28 is preferably a leaf switch, as shown in FIG. 1, and will be switched on by a protrusion 268 on the retaining plate 266 when the retaining plate 266 is moved downwards.

Figure 3:
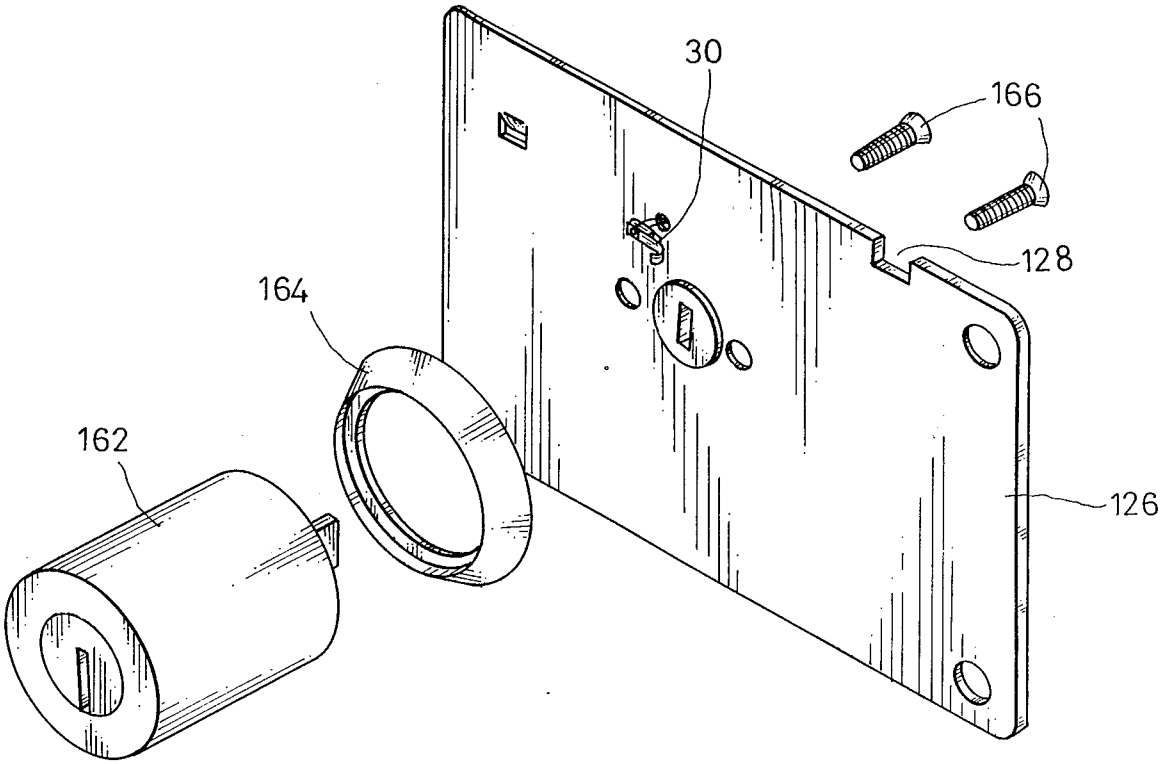
FIG. 3 is an exploded perspective view of the rear parts of the door lock of FIG. 1.
Figure 4:
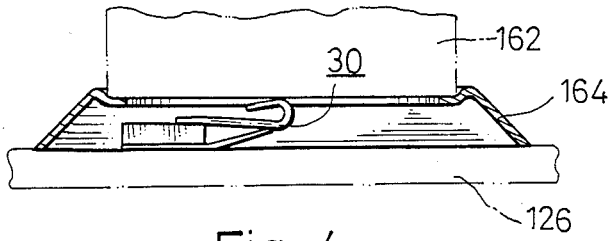
FIGS. 4 and 5 are schematic elevational views of the rear parts of the door lock of FIG. 1, with parts broken away to show the operations of a fifth switch.
Figure 5:
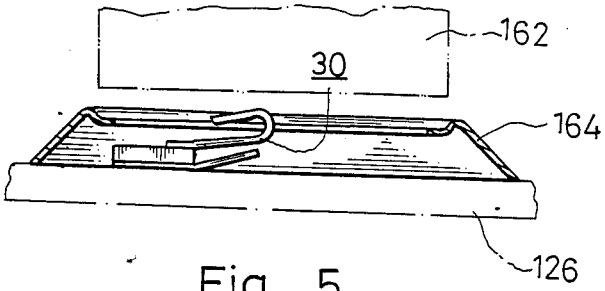

With reference to FIG. 3, there is shown the rear parts of the door lock 10. A back plate 126 is a part of the housing 12, and is releasably secured to the housing 12 of FIG. 1. The back plate 126 is provided with an aperture 128 out of which the operating finger 222 of the second switch 22 emerges. A lock cylinder 162 is secured to the back plate 126 by two screws 166, and a cylinder mount 164 is disposed between the lock cylinder 162 and the back plate 126. A fifth switch 30 is secured to the back plate 126 and under the lock cylinder 162. The fifth switch 30 is preferably a leaf switch. When the lock cylinder 162 is firmly secured on the back plate 126, the fifth switch 30 will be switched on, as shown in FIG. 4. When the lock cylinder 162 is forced to separate from the back plate 126 by the burglar, the fifth switch 30 will be switched off, as shown in FIG. 5. The lock cylinder 162 is a part of the lock mechanism 16. When the door lock 10 is fastened to the door, the back plate 126 fits tightly onto the inside of the door, and the lock cylinder 162 extends through the door and is exposed outside the house for the user to operate with a key. The lock mechanism 16 also includes another lock cylinder 168 mounted on the front of the door lock, as shown in FIG. 11, for being operated from the inside. Since this is also prior art, detailed description is deemed unnecessary.

Figure 6:
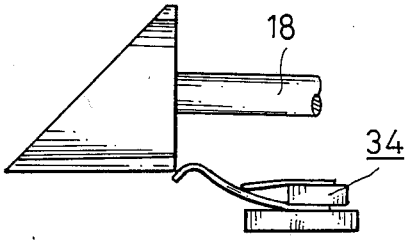
FIGS. 6 and 7 are schematic elevational views of a latch bolt and a sixth switch of the door lock of FIG. 1, showing the operations of the sixth switch.
Figure 7:
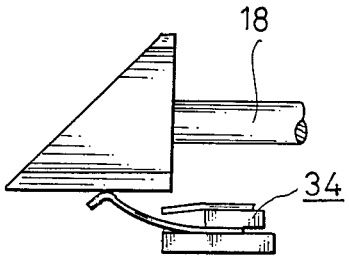

Referring to FIGS. 1, 6, and 7, the door lock 10 preferably includes a sixth switch 34 secured to the housing 10 and in the moving path of the latch bolt 18. The sixth switch 34 is preferably a leaf switch. When the latch bolt 18 is pulled rightwards, the sixth switch 34 will be switched off, as shown in FIG. 7. When the latch bolt 18 springs back to its locked position, the sixth switch 34 will be switched on, as shown in FIG. 6.

It should be noted that the switching states of the fourth to sixth switches 28, 30 and 34 are not intended to be limited to the above, so the types or configurations of the switches can be properly selected, according to the kind of the alarm apparatus with which the door lock 10 is incorporated, to appear at the desired switching states under certain conditions. Therefore, the switching states may be reversed under the same circumstances as described above. Various types and configurations of the leaf switches 28, 30 and 34 can be easily achieved by those who are skilled in the art. It should be also noted that the leaf switches 28, 30 and 34 are properly insulated with the metal parts of the door lock, which they may contact, in being correctly changed to their switching states.

Figure 8:
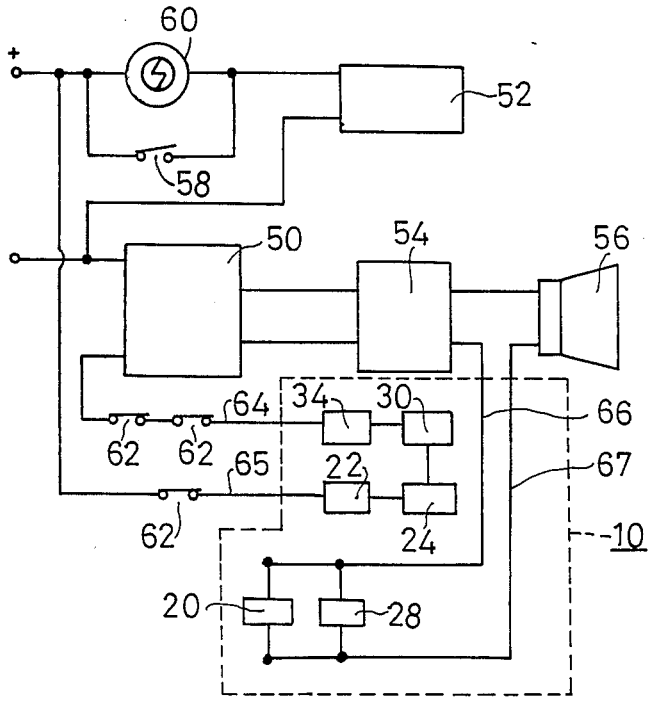
FIG. 8 is a schematic electrical diagram of an alarm system incorporating the door lock of the present invention.

According to the structure described above, the door lock 10 can be applied to any kind of alarm apparatus. For helping the reader clearly to understand the present invention, one example of an alarm apparatus is illustrated in FIG. 8, and incorporates with the door lock 10 to form an improved alarm system. The alarm apparatus is a well-known micro-computer ultrasonic burglar alarm system comprising a main station 50 and a sub-station 52. The main station 50 includes many monitoring functions. Since such functions are not related to the spirit of the present invention, detailed description is deemed unnecessary. The sub-station 52 is ultrasonically controlled by the main station 50. If the power of the main station 50 is disconnected, the substation 52 will lose control, and thus generate an alarm signal. The alarm apparatus also includes a transformer 54 coupled with the main station 50 and a horn 56. The sub-station 52 is coupled with the commercial power through a manually operated switch 58 and a key switch 60 connected to the switch 58 in parallel. The main station 50 is coupled with the commercial power through the second, third, fifth and sixth switches 22, 24, 30 and 34, and several normal closed switches 62, all connected in series. One output terminal of the transformer 54 is connected to one input terminal of the horn 56. The first and fourth switches 20 and 28 are connected in parallel and between the other output terminal of the transformer 54 and the other input terminal of the horn 56. In this system, the normal closed switches 62 are mounted on the windows and/or rear door to detect the opening thereof. In this system, the first and fourth switches 20 and 28 are at the "OFF" states, and the second, third, fifth and sixth switches 22, 24, 30 and 34 are at the "ON" states in ordinary circumstances.

To turn on this system, the manually operated switch 58 or key switch 60 is switched on, and the first or fourth switch 20 or 28 is switched on by operating the lock mechanism 16 with a key to move the bolt assembly 14 into its locked position, or by turning the knob 262 clockwise to move the retaining plate 266 downwards. In this way, the whole alarm system is correctly built up. In this circumstance, if one of the windows or the rear door is opened, the normal closed switch 62 is switched off. Thus, the main station 50 is powered off, and the sub-station 52 loses control, and, as a result, generates an alarm signal. Or, if the main station 50 detects any burglars in the house, it will activate the horn 56 through the transformer 54 to generate an alarm signal. If the burglar wants to enter the house from the front door, and finds that the door lock 10 cannot be picked by skeleton keys and picklocks, in most cases, he will pry open and/or damage the door lock to enter into the house. For example, he will pry open the door lock with a crowbar or the like, to separate it from the door. According to the present invention, the operating finger 222 of the second switch 22 will spring back to its extended position, i.e. the "OFF" state position, and as a result, the sub-station 52 will generate the alarm signal. The burglar may cut off the connecting lines 64, 65, 66 and 67 from the door lock 10 to the alarm apparatus, intending to turn off the alarm apparatus. Similarly, the sub-station 52 will lose control, and thus generate an alarm signal.

The burglar may pull and maintain the latch bolt 18 at its unlocked position in trying to open the door or facilitating further damaging process. In this case, the sixth switch 34 will be switched off, as shown in FIG. 7, and thus the sub-station 52 will generate the alarm signal. The burglar may saw off the parts of the dead bolt assembly 14 and latch bolt 18, which extends out of the housing 12 to open the door. When the door is opened, the third switch 24 will be switched off, and thus the sub-station 52 will generate the alarm signal. The burglar may force the lock cylinder 162 exposed outside to rotate until the screws 166 are broken, and can then easily move away the lock cylinder 162. Thereafter, a screwdriver or the like can be inserted through the door to unlock the dead bolt assembly 14 and the latch bolt 18. However, in this system, the fifth switch 30 will be switched off when the lock cylinder 162 is slightly moved away from the back plate 126, as shown in FIG. 5, and thus the sub-station 52 will generate the alarm signal. Therefore, by the use of the door lock of the present invention, there is no way for the burglar to enter the house from the front door without activating the alarm signal.

To turn off the alarm system, the switch 58 or 60 is switched off, and the first or fourth switch 20 or 28 is switched off in the manner described above. Therefore, by the use of the door lock 10 of the present invention, the alarm system can be turned on simultaneously with the locking operation of the door lock, and can be turned off simultaneously with the unlocking operation.

It should be understood that the door lock 10 of the present invention can be applied to any kind of alarm apparatus. Although in the above system the manually operated switch 58 and key switch 60 are included, they may be omitted in other systems so that they can be turned on/off only by a single operation of the door lock. It should be also understood that the present invention is not intended to be limited to the triple-step lock illustrated in FIG. 1; any kind of lock having a housing for accommodating the switch elements of the present invention can be adopted. For example, in FIG. 9, there is shown an automatic door lock 70 capable of being adopted by the present invention. The automatic door lock 70 includes a housing 72, a spring-loaded bolt assembly 74, a lock mechanism 76 engaged with the bolt assembly 74, and a spring-loaded bolt retaining mechanism 78. The rear end of the bolt retaining mechanism 78 abuts against the bolt assembly 74 to retain it at an unlocked position against the biasing force exerted by the spring 742. When the door is closed, the door frame will first push the bolt retaining mechanism 78 inwards to the housing 72. In this case, the rear end of the mechanism 78 will slightly move downwards to disengage from the bolt assembly 74, and thus the bolt assembly 74 will be automatically biased to a locked position by the spring 742. When the user operates the lock mechanism 76 with a key to move the bolt assembly 74 inwards to the unlocked position, the mechanism 78 will be automatically biased by a spring 782 to engage the bolt assembly 74 again so that the door lock is kept at its unlocked position. Since the automatic door lock 70 itself is already in existence, further detailed description is deemed unnecessary.

Figure 9:
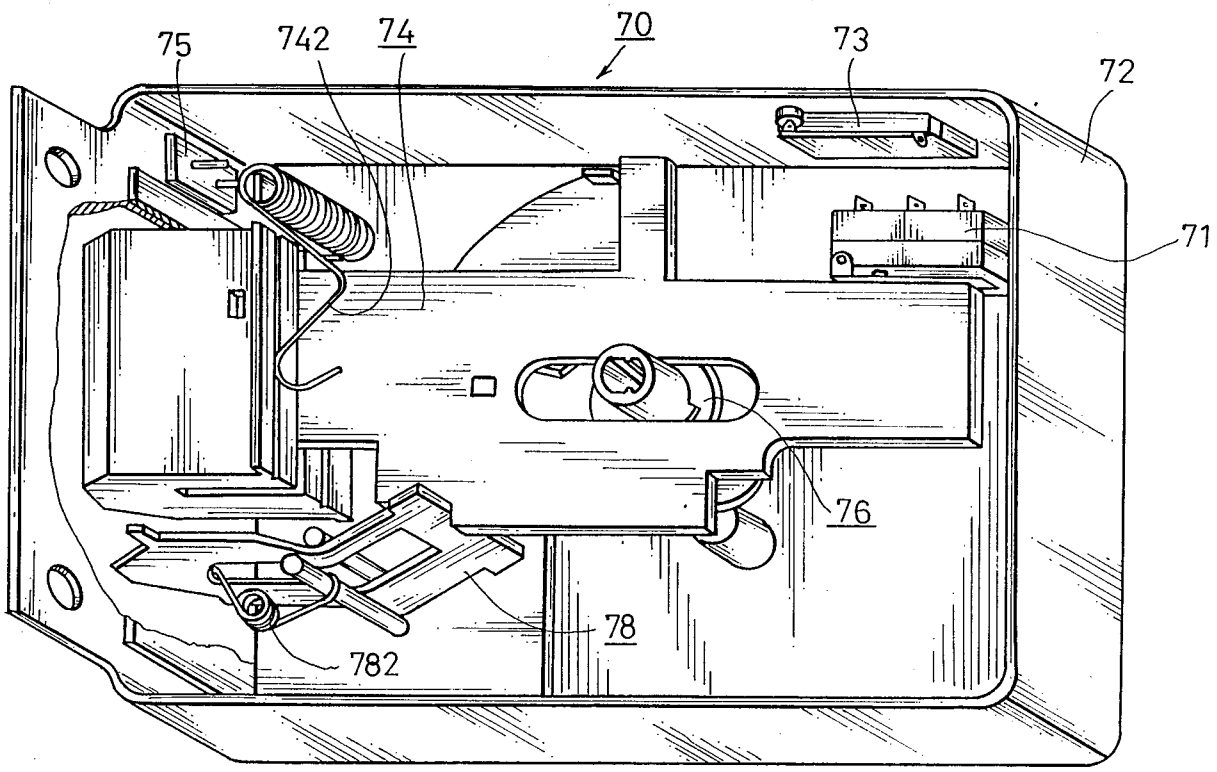
FIG. 9 is an enlarged perspective view of an automatic door lock according to the second preferred embodiment of the present invention, viewed from its back with parts moved and parts broken away to show its inner structure.

A micro-switch 71 similar to the above first switch 20 is secured to the housing 72 and in the moving path of the bolt assembly 74. Similarly, when the bolt assembly is at the unlocked position, the operating finger of the switch 71 is depressed to switch off/on the switch 71, as shown in FIG. 9. When the bolt assembly is at the locked position, the operating finger is released to switch on/off the switch 71. The door lock 70 also includes two switches 73 and 75 respectively, similar to the above second and third switches 22 and 24, and two switches (not shown) similar to the above fourth and fifth switches 28 and 30. Since the door lock 70 has not a spring-loaded latch bolt as provided in the door lock 10, the above sixth switch 34 is not provided in the door lock 70. Since the functions and operations of the switches of the door lock 70 are similar to those described above, no further description is deemed necessary.

Figure 10:
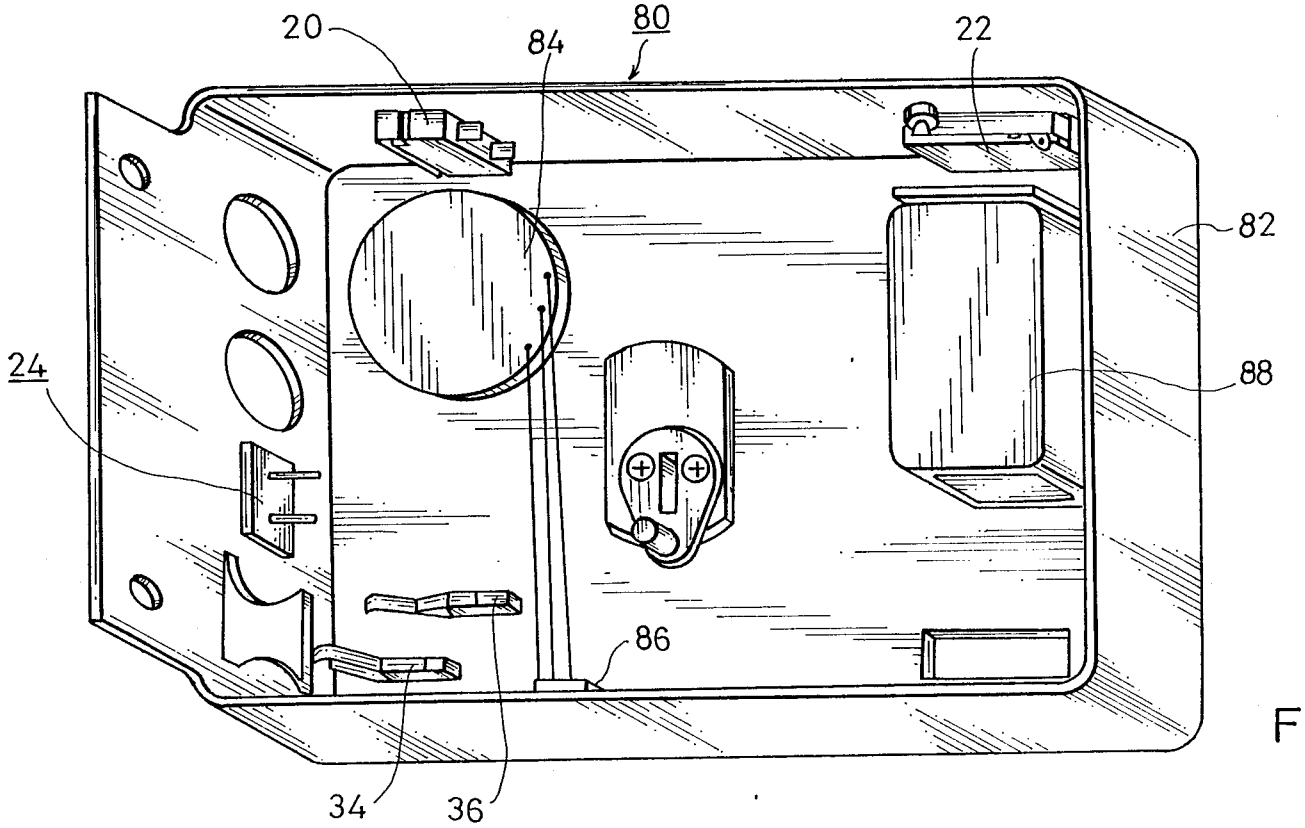
FIG. 10 is an enlarged perspective view of a door lock with an inner-installed alarm device according to the third preferred embodiment of the present invention, viewed from its back with parts moved away to show its inner structure.

According to the other preferred embodiment of the present invention, the alarm apparatus is provided within the door lock 80 as shown in FIG. 10. In FIG. 10, the bolt assembly and the latch bolt of the door lock 80, which are similar to those of the door lock 10 of FIG. 1, are moved away to show clearly the inner structure of the door lock 80. The door lock 80 includes the first to sixth switches 20, 22, 24, 28, 30 and 34 described above. The only difference is that, in this embodiment, the second, third, fifth and sixth switches 22, 24, 30 and 34 are at their "OFF" states under ordinary circumstances. The door lock 80 also includes a buzzer 84 secured to the housing 82 thereof, and a conventional buzzer controlling device 86 secured to the housing 82 and coupled to the buzzer 84. The thickness of the buzzer 84 is properly gauged in order not to hinder the movement of the bolt assembly. A resonator 83, as shown in FIG. 11, is provided on, and projects from, the housing 82, and is aligned with the buzzer 84 to amplify the sound of the alarm signal generated by the buzzer 84. The door lock 80 further includes a power supply device 88 therein, which may be a replaceable dry cell or dry cell battery, or a rechargeable battery.

Figure 12:
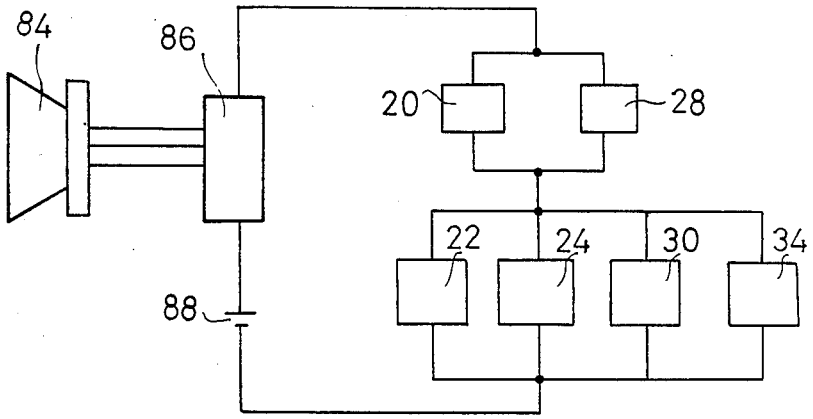
FIG. 12 is a schematic electrical diagram of the circuitry arranged within the door lock of FIG. 10 or 11.
Figure 13:
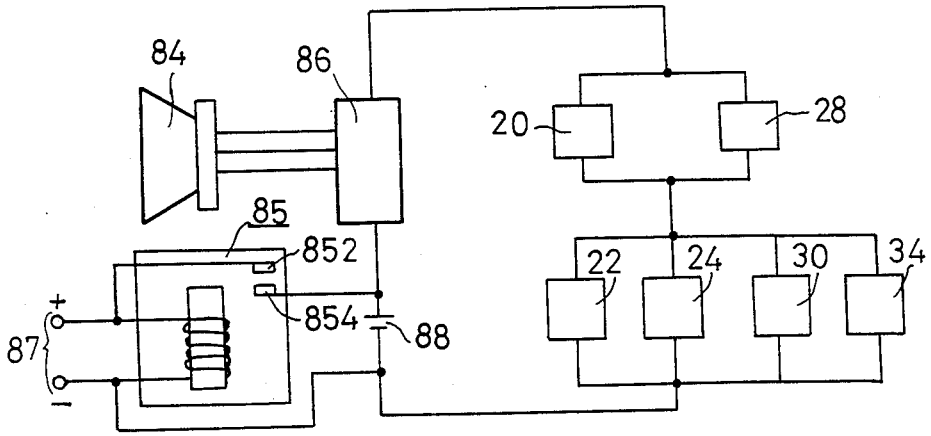
FIG. 13 is a schematic electrical diagram of the circuitry of FIG. 12 incorporating a charge circuit.

The connecting relationship of the first to sixth switches 20, 22, 24, 28, 30 and 34 is illustrated in FIGS. 12 and 13. In this embodiment, the first and fourth switches 20 and 28 are connected in parallel to form a first switch set, and the second, third, fifth and sixth switches 22, 24, 30 and 34 are connected in parallel to form a second switch set. The first and second switch sets are connected in series, and then coupled to the buzzer controlling device 86 via the power supply device 88. To turn on this alarm system, one can either use a key to move the bolt assembly to the locked position so that the first switch 20 is switched on, or turn the knob 262 clockwise to move the retaining plate downwards so that the fourth switch 28 is switched on, as described above. When this system is turned on, and the burglar damages the door lock or the door in order to open the door in any one of the ways described above, the buzzer 84 will be activated by the buzzer controlling device 86 to generate the alarm signal which is in turn amplified by the resonator 83. The amplified alarm signal frightens the burglar and attracts the attention of the person inside the house and the neighbors. Therefore, the door lock 80 can offer more reasonable security than the conventional door lock. Furthermore, since the manufacturing cost of the door lock 80 is cheap, the door lock of the present invention can be widely used.

If the power supply device 88 is a rechargeable battery, a charge circuit is provided within the door lock 80. Referring to FIG. 13, the charge circuit includes a relay 85, and a socket 87 coupled to the relay 85. The socket 87 is provided on the housing, and is exposed to the outside to facilitate the connection with commercial power when desired. When the commercial power is connected, the contacts 852 and 854 of the relay 85 are connected together so that the battery 88 is charged. The primary advantage of the relay 85 is that when the terminals of the socket 87 is shorted by the burglar, the contacts 852 and 854 will be disconnected so that the battery 88 will not be shorted. Therefore, the door lock 80 is also subject to ordinary working circumstances.

Furthermore, the conventional triple-step door lock has the function of pulling the latch bolt 18 to the unlocked position, thereby moving the retaining plate downwards to maintain the latch bolt at the unlocked position. By this means, the door is kept open if the dead bolt assembly is also at the unlocked position. Sometimes, the user would prefer to use this function. However, at this time, the fourth and sixth switches 28 and 34 are all turned on in accordance with the structure of the door lock 80, therefore the buzzer 84 will generate an alarm signal. To avoid this problem, the door lock 80 may further include a seventh switch 36 secured to the housing 82 and also in the moving path of the latch bolt 18, as shown in FIG. 10. The sixth and seventh switches 34 and 36 are so arranged that the latch bolt 18 will first operate the sixth switch 34 when being slightly moved inwards, and operate the seventh switch 36 later when being moved near its unlocked position. The seventh switch 36 is preferably a leaf switch the configuration of which is similar to that of the leaf switch 34 as shown in FIG. 6 or 7 so that it is at the "ON" state when the latch bolt 18 is at the locked position, and will be switched off when the latch bolt is at the unlocked position.

When the seventh switch 36 is applied to the circuitry of FIG. 12 or 13, it is connected in series with the fourth switch 28, and both are in turn connected in parallel to the first switch 20. If the user uses the above-described function, the fourth and sixth switches 28 and 34 are switched on, but the seventh switch 36 is switched off. Therefore, the buzzer 84 is turned off to avoid an undesired alarm signal. When the latch bolt 18 is at the locked position, and the retaining plate 266 is moved downwards to retain the latch bolt at that position, the fourth and seventh switches 28 and 36 are both at their "ON" states. Therefore, the alarm apparatus of the door lock 80 is in the normal working position. In this case, since it is impossible to move the latch bolt 18 to the unlocked position, the seventh switch 36 will not be switched off to turn off the alarm apparatus of the door lock 80.

It should be noted that the buzzer 84 may be replaced by any proper loudspeaker, horn, or alarm bell.

While the invention has been described in terms of what is presently considered to be the most practical and preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A door lock for locking a door within a door frame, comprising a housing, a bolt assembly, a lock mechanism engaged with said bolt assembly and capable of being operated by a user with a key to move said bolt assembly between a locked position and an unlocked position, and being characterized in that said door lock includes first means, secured to said housing and in the moving path of said bolt assembly, and adapted to couple with an alarm apparatus, for turning on said alarm apparatus when said bolt assembly is moved to said locked position, and for turning off said alarm apparatus when said bolt assembly is moved to said unlocked position, and second means, secured to said housing, and adapted to couple with said alarm apparatus, for activating said alarm apparatus to generate said alarm signal when said alarm apparatus is turned on, and the door is opened, and wherein said second means includes a magnet-controlled switch secured to and slightly projecting out of said housing, and a magnet secured to said door frame and confronting said magnet-controlled switch to control said magnet-controlled switch.

2. The door lock as claimed in claim 1, further comprising third means, secured to said housing, and adapted to couple with said alarm apparatus, for activating said alarm to generate an alarm signal when said alarm apparatus is turned on, and said door lock is detached from the door.

3. The door lock as claimed in claim 2, further comprising fourth means, secured to said housing and adapted to couple with said alarm apparatus, for being manually operated to turn on/off said alarm apparatus; and fifth means, secured to said housing, and adapted to couple with said alarm apparatus, for activating said alarm apparatus to generate said alarm signal when said alarm apparatus is turned on, and said lock mechanism is forced to separate from said housing.

4. The door lock as claimed in claim 3, wherein said first and third means are micro-switches having operating members, the operating member of said first means extending into the moving path of said bolt assembly for being operated by said bolt assembly, the operating member of said third means projecting out of said housing and confronting the door so that it is depressed when said door lock is secured to the door, and springs back to its extended position when said door lock is detached from the door.

5. The door lock as claimed in claim 4, wherein said bolt assembly includes a spring-loaded latch bolt and a dead bolt, wherein the operating member of said first means extends into the moving path of said dead bolt, and wherein said door lock further comprises sixth means, secured to said housing and in the moving path of said latch bolt, and adapted to couple with said alarm apparatus, for activating said alarm apparatus to generate said alarm signal when said alarm apparatus is turned on, and said latch bolt is moved into its unlocked position.

6. The door lock as claimed in claim 5 wherein said fourth, fifth and sixth means are leaf switches.

7. A door lock for locking a door within a door frame, comprising a housing, a bolt assembly, a lock mechanism engaged wih said bolt assembly and capable of being operated by a user with a key to move said bolt assembly between a locked position and an unlocked position, and being characterized in that said door lock includes an alarm apparatus secured to said housing and adapted to couple with a power supply device; first means, secured to said housing and in the moving path of said bolt assembly, and coupled with said alarm apparatus, for turning on said alarm apparatus when said bolt assembly is moved to said locked position, and for turning off said alarm apparatus when said bolt assembly is moved to said unlocked position; and alarm activating means, secured to said housing and coupled with said alarm apparatus through said first means, for activating said alarm apparatus to generate an alarm signal when said alarm apparatus is turned on, and the door lock is damaged by the burglar in order to open the door, wherein said alarm activating means includes second means for activating said alarm apparatus to generate said alarm signal when said alarm apparatus is turned on, and the door is opened, and wherein said second means includes a magnet-controlled switch secured to and slightly projecting out of said housing, and a magnet secured to said door frame and confronting said magnet-controlled switch to control said magnet-controlled switch.

8. The door lock as claimed in claim 7, wherein said alarm activating means includes third means for activating said alarm apparatus to generate said alarm signal when said alarm apparatus is turned on, and said door lock is forced to separate from the door.

9. The door lock as claimed in claim 8, wherein said alarm activating means includes fourth means for activating said alarm apparatus to generate said alarm signal when said alarm apparatus is turned on, and said lock mechanism is forced to separate from said housing.

10. The door lock as claimed in claim 9, further comprising fifth means, secured to said housing, connected in parallel with said first means, and coupled with said alarm apparatus, for being manually operated to turn on/off said alarm apparatus.

11. The door lock as claimed in claim 10, wherein said first and third means are micro-switches having operating members, the operating member of said first means extending into the moving path of said bolt assembly for being operated by said bolt assembly, the operating member of said third means projecting out of said housing and confronting the door so that it is depressed when said door lock is secured to the door, and springs back to its extended position when said door lock is separated from the door.

12. The door lock as claimed in claim 11, wherein said bolt assembly includes a spring-loaded latch bolt and a dead bolt, wherein the operating member of said first means extends into the moving path of said dead bolt, and wherein said door lock further comprises sixth means, secured to said housing and in the moving path of said latch bolt, and adapted to couple with said alarm apparatus, for activating said alarm apparatus to generate said alarm signal when said alarm apparatus is turned on, and said latch bolt is moved into its unlocked position.

13. The door lock as claimed in claim 12, wherein said fourth, fifth and sixth means are leaf switches.

14. The door lock as claimed in claim 13, wherein said alarm apparatus includes a resonator secured to said housing to amplify the sound of said alarm signal generated by said alarm apparatus.

15. The door lock as claimed in claim 14, wherein said power supply device is a replaceable battery accommodated within said housing.

16. The door lock as claimed in claim 14, wherein said power supply device is a rechargeable battery accommodated within said housing, and wherein said door lock further comprises relay means, coupled with said rechargeable battery and adapted to connect to a power source, for charging said battery when the power source is connected, and for preventing said battery from being shorted when the power source is disconnected or shorted.

17. The door lock as claimed in claim 16, further comprising a socket secured to said housing, exposed to outside, and coupled with said relay means to facilitate the connection of said power source to said relay means.

18. A door lock for locking a door within a door frame, comprising a housing, a bolt assembly, a lock mechanism engaged with said bolt assembly and capable of being operated by a user with a key to move said bolt assembly between a locked position and an unlocked position, and being characterized in that said door lock includes first means, secured to said housing and in the moving path of said bolt assembly, and adapted to couple with an alarm apparatus, for turning on said alarm apparatus when said bolt assembly is moved to said locked position, and for turning off said alarm apparatus when said bolt assembly is moved to said unlocked position, and second means, secured to said housing and adapted to couple with said alarm apparatus, for activating said alarm apparatus to generate said alarm signal when said alarm apparatus is turned on, and said lock mechanism is forced to separate from said housing.

19. A door lock for locking a door within a door frame, comprising a housing, a bolt assembly, a lock mechanism engaged with said bolt assembly and capable of being operated by a user with a key to move said bolt assembly between a locked position and an unlocked position, and being characterized in that said door lock includes an alarm apparatus secured to said housing and adapted to couple with a power supply device; first means, secured to said housing and in the moving path of said bolt assembly, and coupled with said alarm apparatus, for turning on said alarm apparatus when said bolt assembly is moved to said locked position, and for turning off said alarm apparatus when said bolt assembly is moved to said unlocked position; and alarm activating means, secured to said housing and coupled with said alarm apparatus through said first means, for activating said alarm apparatus to generate an alarm signal when said alarm apparatus is turned on, and the door lock is damaged by the burglar in order to open the door, wherein said alarm activating means includes second means for activating said alarm apparatus to generate said alarm signal when said alarm apparatus is turned on, and said lock mechanism is forced to separate from said housing.

* * * * *